US008359952B2

(12) United States Patent
Hsieh

(10) Patent No.: US 8,359,952 B2
(45) Date of Patent: Jan. 29, 2013

(54) OPEN-END WRENCH

(76) Inventor: Chih-Ching Hsieh, Taichung Hsien (TW)

( * ) Notice: Subject to any disclaimer, the term of this patent is extended or adjusted under 35 U.S.C. 154(b) by 290 days.

(21) Appl. No.: 12/478,539

(22) Filed: Jun. 4, 2009

(65) Prior Publication Data

US 2009/0235787 A1 Sep. 24, 2009

Related U.S. Application Data

(63) Continuation-in-part of application No. 11/853,035, filed on Sep. 11, 2007, now abandoned, which is a continuation-in-part of application No. 11/146,261, filed on Jun. 7, 2005, now abandoned.

(51) Int. Cl.
*B25B 13/02* (2006.01)

(52) U.S. Cl. ..... 81/119; 81/186; 81/418

(58) Field of Classification Search ..... 81/119, 81/120, 121.1, 122, 124.3, 124.7, 125.1, 81/165, 186, 418
See application file for complete search history.

(56) References Cited

U.S. PATENT DOCUMENTS

| | | | | | |
|---|---|---|---|---|---|
| 2,991,677 | A | * | 7/1961 | Savarin | 81/158 |
| 5,074,171 | A | | 12/1991 | Annis et al. | |
| 5,148,726 | A | * | 9/1992 | Huebschen et al. | 81/119 |
| 5,476,024 | A | | 12/1995 | Hsieh | |
| D409,061 | S | | 5/1999 | Hsieh | |
| 5,996,449 | A | * | 12/1999 | Hsieh | 81/186 |
| 6,009,778 | A | * | 1/2000 | Hsieh | 81/119 |
| 6,145,414 | A | | 11/2000 | Hsieh | |
| 6,269,715 | B1 | | 8/2001 | Cagny | |
| 2005/0166720 | A1 | | 8/2005 | Wright et al. | |
| 2006/0086212 | A1 | | 4/2006 | Hsieh | |

* cited by examiner

*Primary Examiner* — Robert Scruggs
(74) *Attorney, Agent, or Firm* — Guice Patents PLLC

(57) ABSTRACT

The present invention is related to an open-end wrench including a first jaw and a second jaw and a throat section connected between rear ends of the two jaws. A toothed section is disposed on the inner side of the first jaw. The toothed section has multiple sharp teeth and a wide tooth positioned behind the sharp teeth. The wide tooth has a largest width among all the teeth. The bottommost point of the throat section is spaced from a front end of the first jaw by a first length. The bottommost point of the throat section is spaced from the tooth crest of the wide tooth by a second length, which ranges from ⅓ to ½ the first length. In addition, the toothed section has a third length, which is about ⅖ the first length.

12 Claims, 6 Drawing Sheets

OPEN-END WRENCH

This application is a continuation-in-part of application Ser. No. 11/853,035 filed Sep. 11, 2007, now abandoned which is a continuation-in-part of application Ser. No. 11/146,261, filed Jun. 7, 2005, now abandoned.

FIELD OF THE INVENTION

The present invention is related to a hand tool, and more particularly to an open-end wrench in which the innermost tooth of the jaw is protected from being damaged.

BACKGROUND OF THE INVENTION

A wrench is a hand tool for wrenching a nut/bolt. The applicant's U.S. Pat. No. 6,009,778, entitled "structure of open end wrench", discloses an open-end wrench 10 as shown in FIG. 1. The open-end wrench 10 has a first jaw 12 and a second jaw 15. Seven continuously arranged teeth 14 are disposed on the holding face of the first jaw 12. A raised section 16 is disposed on the holding face of the second jaw 15. In use, the two jaws 12, 15 hold a threaded component 18 with the teeth 14 and the raised section 16 abutting against two sides of the threaded component to wrench the threaded component.

In practice, the above structure has some shortcomings as follows:

First, when wrenching the threaded component, the innermost tooth 14*a* of the first jaw 12 will bear a considerably great stress and is apt to break. This will deteriorate the wrenching effect of the wrench.

Second, the two innermost teeth 14*a*, 14*b* of the jaw 12 are quite adjacent to the corner 19 of the threaded component 18. The teeth have sharp tips, which tend to thrust into the side 181 or the corner 19 of the threaded component. As a result, it often takes place that the wrench is stuck with the threaded component and hard to separate therefrom.

Third, the innermost tooth 14*a* is engaged with the corner 19 of the threaded component 18 and tends to damage the corner 19.

SUMMARY OF THE INVENTION

It is therefore a primary object of the present invention to provide an open-end wrench. A toothed section having multiple teeth is disposed on a holding face of a jaw of the wrench. An innermost tooth of the toothed section has better structural strength and is uneasy to damage.

The open-end wrench of the present invention includes a first jaw and a second jaw and a throat section connected between rear ends of the two jaws. Each of the jaws has an inner side serving as a holding face. A toothed section is disposed on the holding face of the first jaw. The toothed section has multiple sharp teeth and a wide tooth positioned behind the sharp teeth. The wide tooth has a largest width among all the teeth. A raised section is disposed on the holding face of the second jaw.

The throat section defines a recess having a bottommost point. The bottommost point of the throat section is spaced from a front end of the first jaw by a first length. The bottommost point is spaced from the tooth crest of the wide tooth by a second length, which ranges from ⅓ to ½ the first length.

The toothed section has a length defined as a third length. Preferably, the third length is about ⅖ the first length.

According to the above arrangement, the strength of the innermost tooth of the first jaw is enhanced.

The present invention can be best understood through the following description and accompanying drawings wherein:

DETAILED DESCRIPTION OF THE PREFERRED EMBODIMENTS

Figure 1:
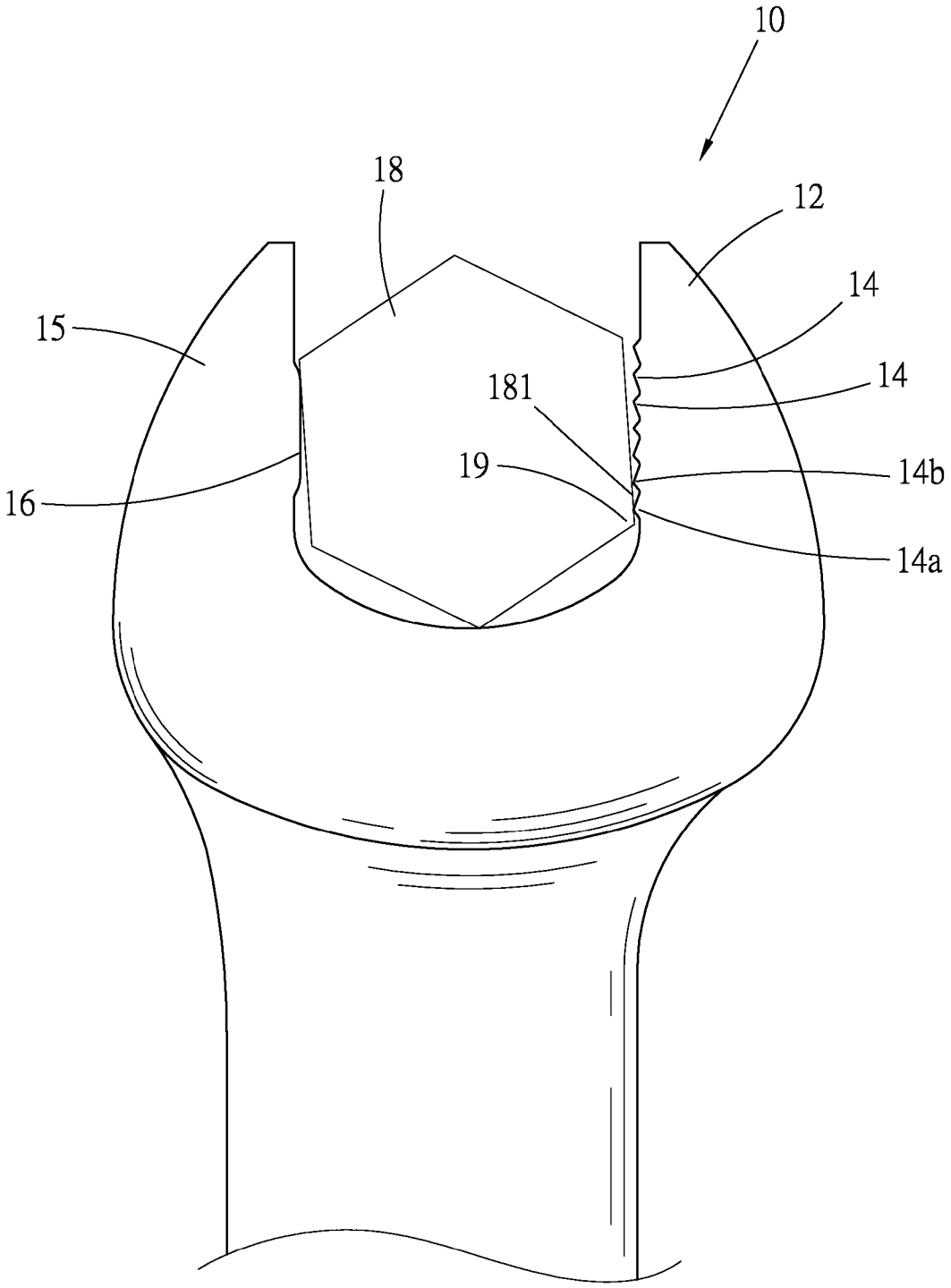
Fig. 1 PRIOR ART
FIG. 1 is a front view of a conventional open-end wrench, showing the use thereof.
Figure 2:
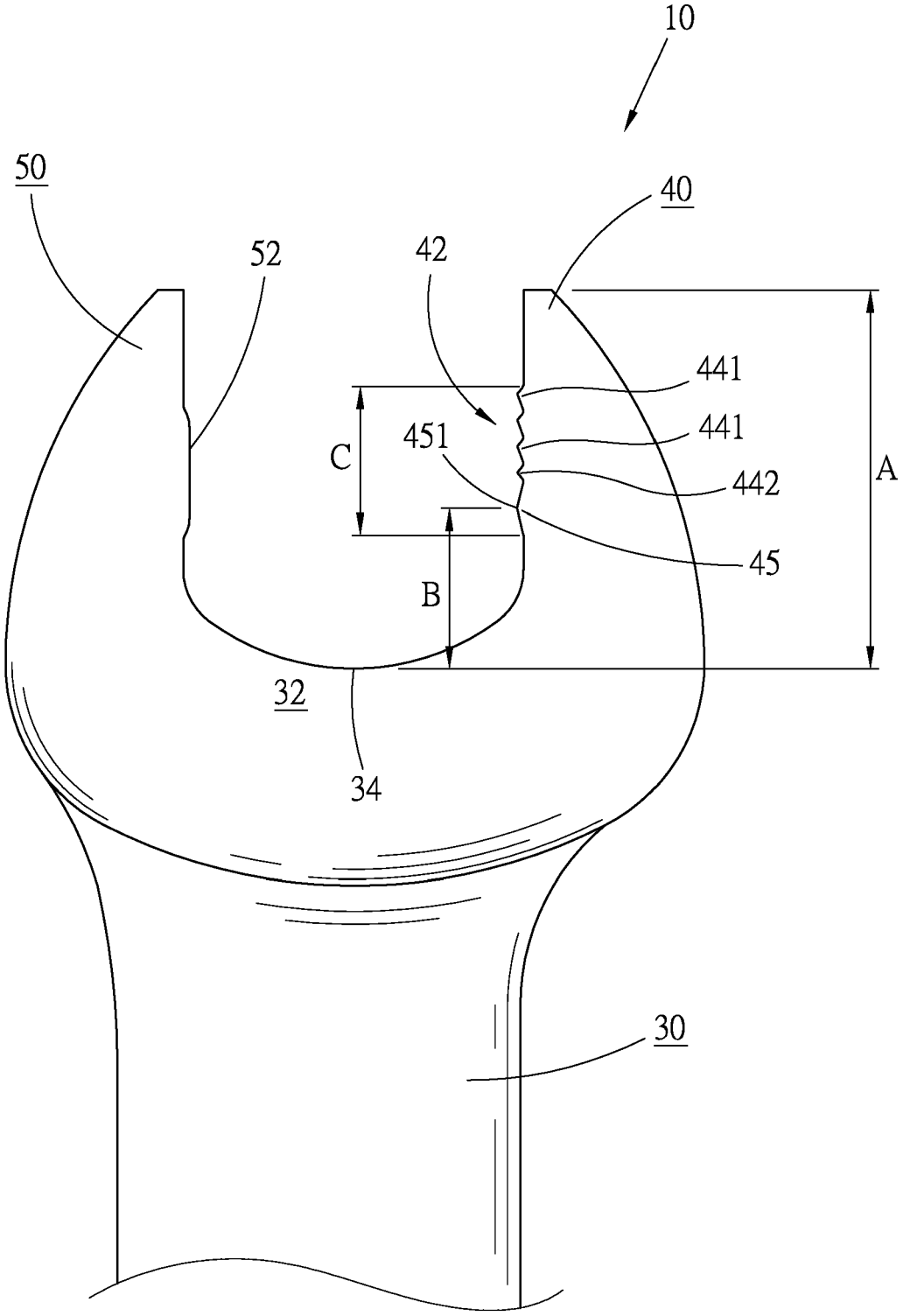
FIG. 2 is a front view of a first embodiment of the present invention.

Please refer to FIG. 2. According to a first embodiment, the open-end wrench 20 of the present invention includes a handle 30 and two jaws 40, 50 disposed at one end of the handle. A throat section 32 is connected between rear ends of the two jaws to space the two jaws from each other by a certain distance. Each of the jaws 40, 50 has an inner side serving as a holding face.

A toothed section 42 is disposed on the holding face of the first jaw 40. The toothed section 42 has multiple teeth arranged from a front side to a rear side. A raised section 52 with a plane face is disposed on the holding face of the second jaw 50. The two jaws serve to hold a threaded component with the toothed section 42 and the raised section 52 abutting against two sides of the threaded component.

Figure 3:
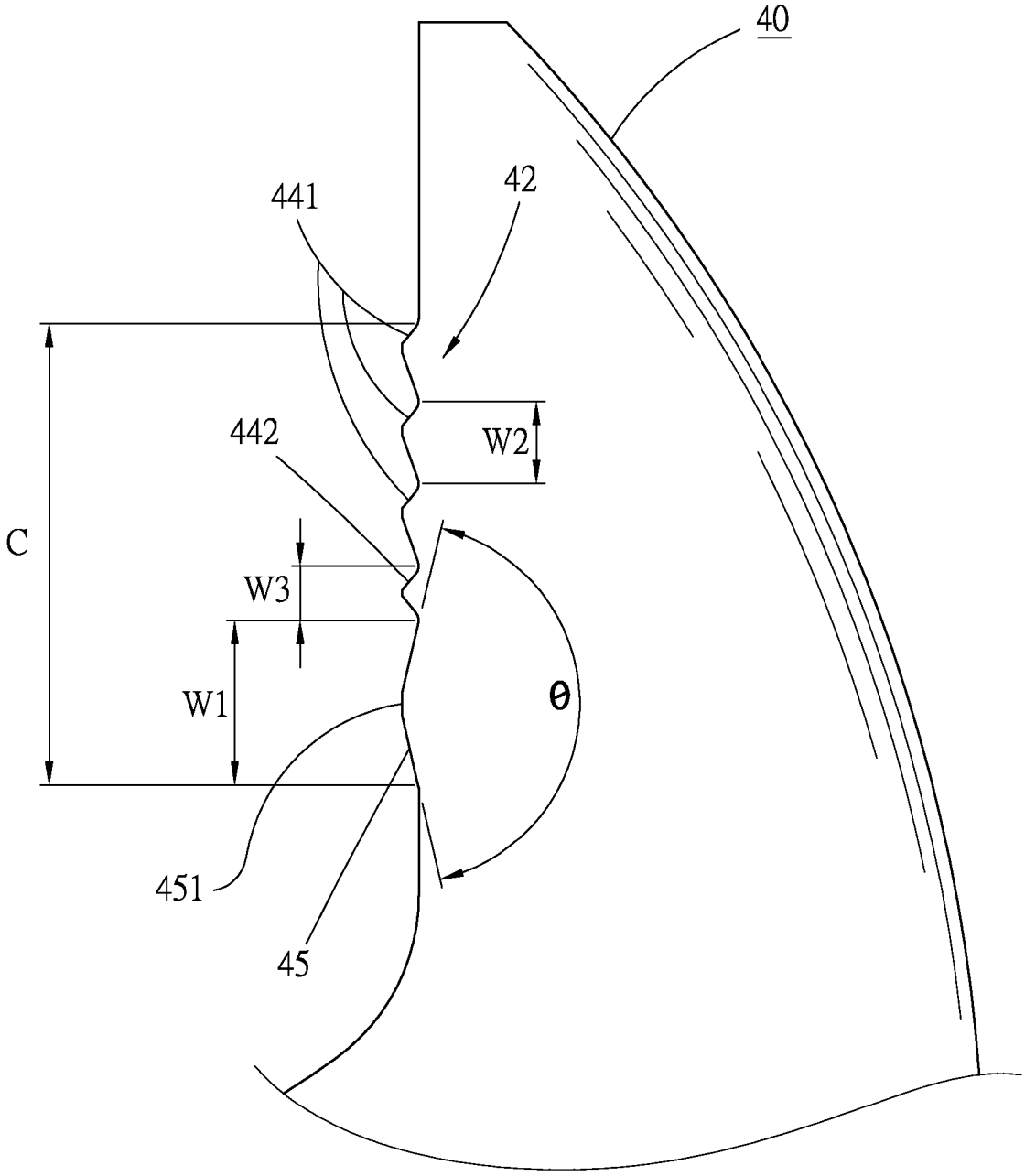
FIG. 3 is an enlarged view of a part of FIG. 2.

Referring to FIG. 3, the toothed section 42 of the first jaw 40 has multiple sharp teeth 441, 442 and a wide tooth 45 positioned behind the sharp teeth. The wide tooth 45 has a largest width w1 among the teeth, that is, the width w1 of the wide tooth 45 is larger than the width of any of the sharp teeth 441, 442. Preferably, the wide tooth 45 has the form of an isosceles triangle. The angle θ contained between the lateral sides ranges from 150° to 158°. The sharp teeth can be divided into multiple first sharp teeth 441 and a second sharp tooth 442. The second sharp tooth 442 is closest to the wide tooth 45 and has a smallest width w3. Preferably, the second sharp tooth 442 has the form of an isosceles triangle. The width w3 of the second sharp tooth is smaller than the width w2 of any of the first sharp teeth 441. Each first sharp tooth 441 has the form of a non-isosceles triangle. The width w2 of the first sharp tooth 441 is between the width of the second sharp tooth 442 and the width of the wide tooth 45.

In addition to the above structure, the respective parts of the wrench 20 are specifically positioned relative to each other. Referring to FIG. 2, the throat section 32 is positioned between the two jaws to define an arc-shaped or V-shaped recess. A bottommost point 34 of the recess is positioned at the center of the throat section 32. In vertical distance, the bottommost point 34 is spaced from a front end of the first jaw 40 by a first length A. The wide tooth 45 has a tooth crest 451. In vertical distance, the bottommost point 34 is spaced from the tooth crest 451 by a second length B. In this embodiment, the distance between the tooth crest 451 of the wide tooth 45 and the bottommost point 34 of the throat section 32, i.e. the second length B, ranges from ⅓ to ½ the first length A.

In addition, the toothed section 42 has a length defined as a third length C. The third length C is about ⅖ the first length A.

The width w1 of the wide tooth 45 is about 0.325~0.375 the third length C and preferably 0.35 the third length C.

Figure 4:
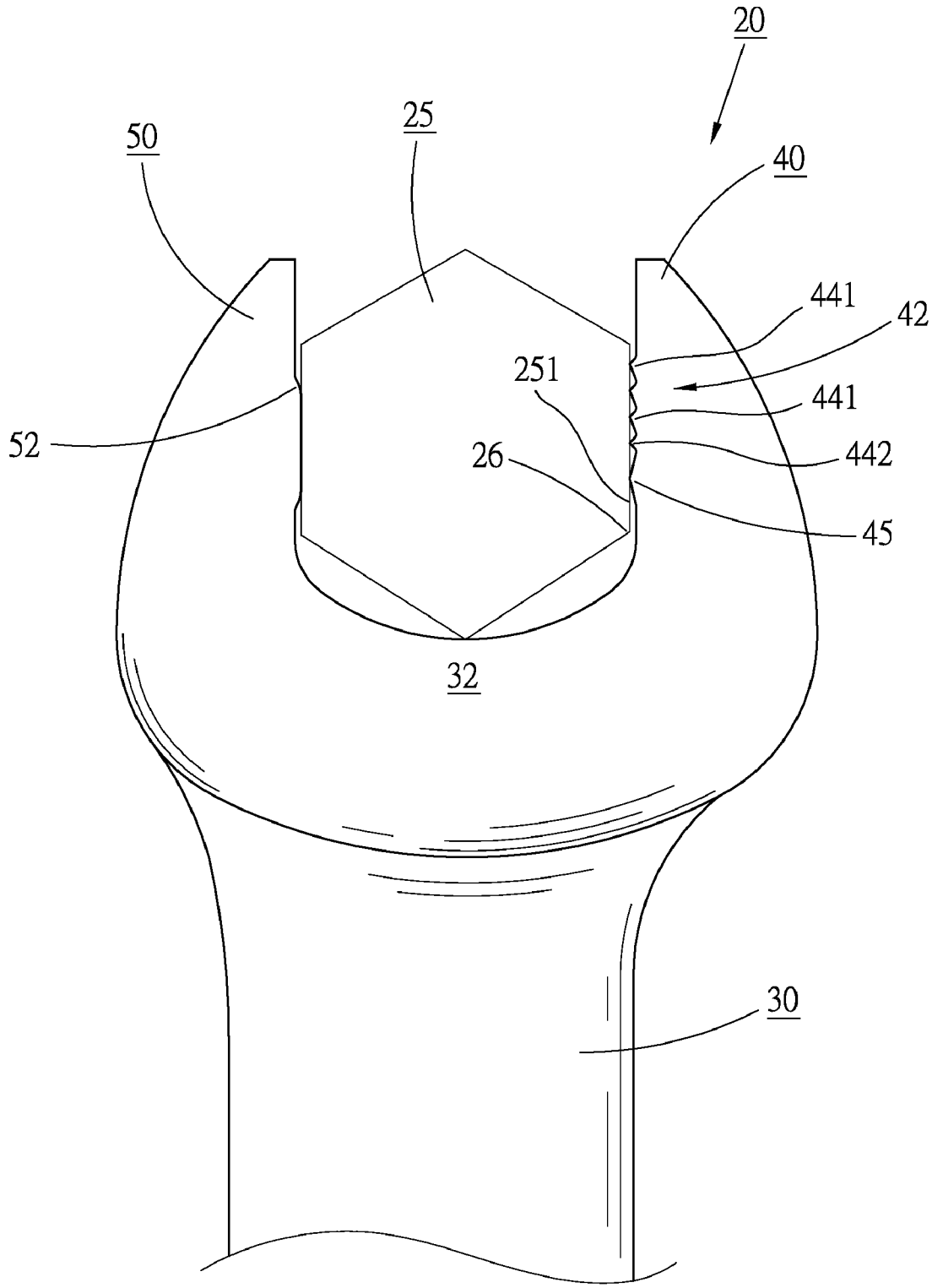
FIG. 4 is a front view of the first embodiment of the present invention, showing the use thereof.

Referring to FIG. 4, in use, the two jaws 40, 50 of the wrench 10 hold a threaded component 25 with the toothed section 42 and the raised section 52. The wide tooth 45 has a considerably large width with an obtuse angle so that the structural strength of the wide tooth 45 is enhanced. When touching the threaded component, the wide tooth 45 is able to bear greater force without breaking. Moreover, according to the above specific position relationship between the respective parts of the wrench 10, the tooth crest 451 of the wide tooth 45 is spaced from the corner 26 of the threaded component 25 by a certain distance without compressing the corner 26. Also, the tooth crest of the wide tooth is not a sharp tip so that the tooth crest will not thrust into or damage the corner 26 or the side 251 of the threaded component 25. Therefore, the wrench will not be stuck with the threaded component.

It should be noted that the wrench 10 not only is applicable to a normal threaded component, but also is applicable to a threaded component with worn corners.

Figure 5:
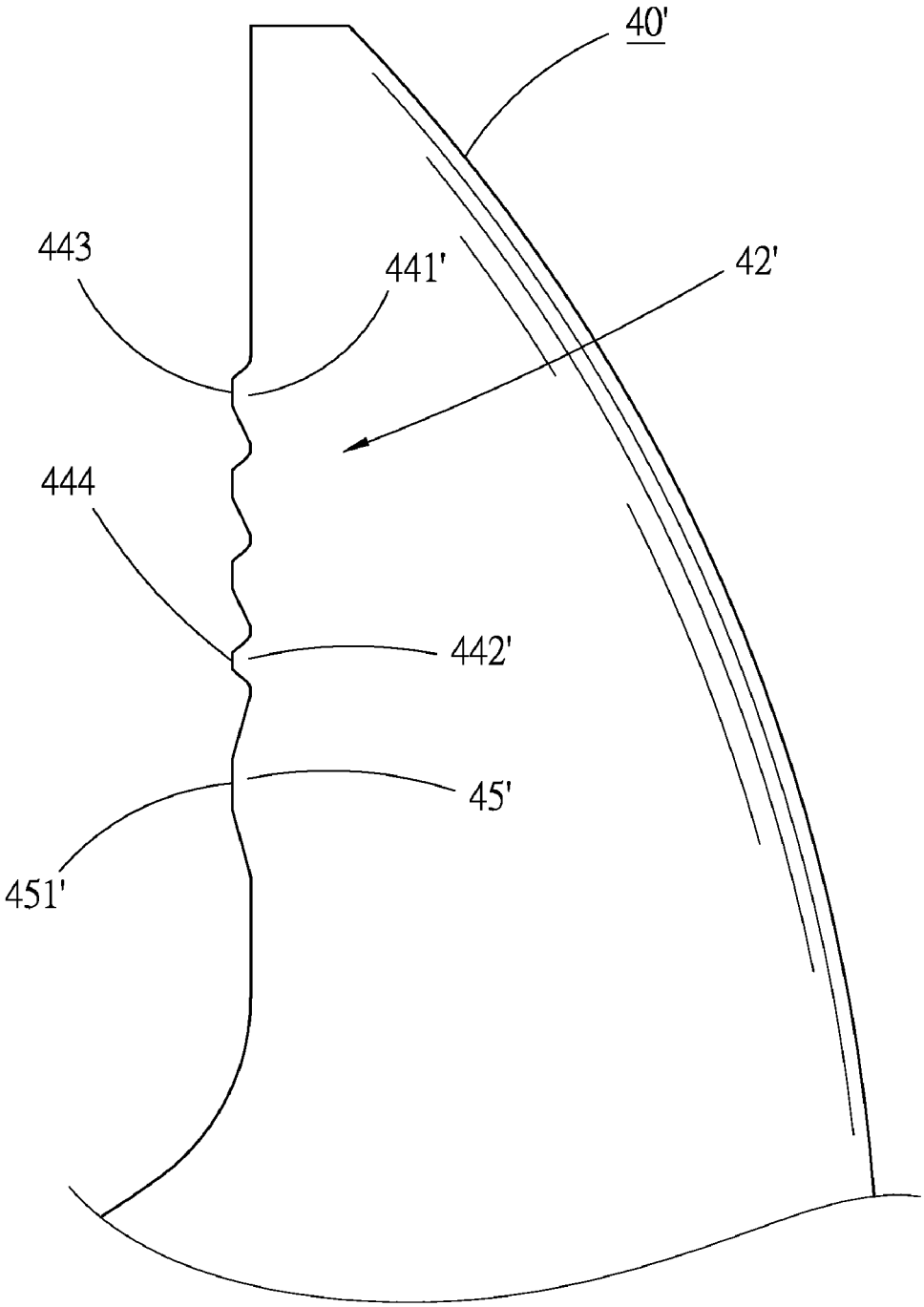
FIG. 5 is an enlarged view of a part of a second embodiment of the present invention.

FIG. 5 shows a second embodiment of the wrench 20' of the present invention, which has a structure substantially identical to that of the first embodiment. The second embodiment is different from the first embodiment in that the sharp teeth 441', 442' and the wide tooth 45' of the first jaw 40' have plane tooth crests 443, 444, 451'.

Figure 6:
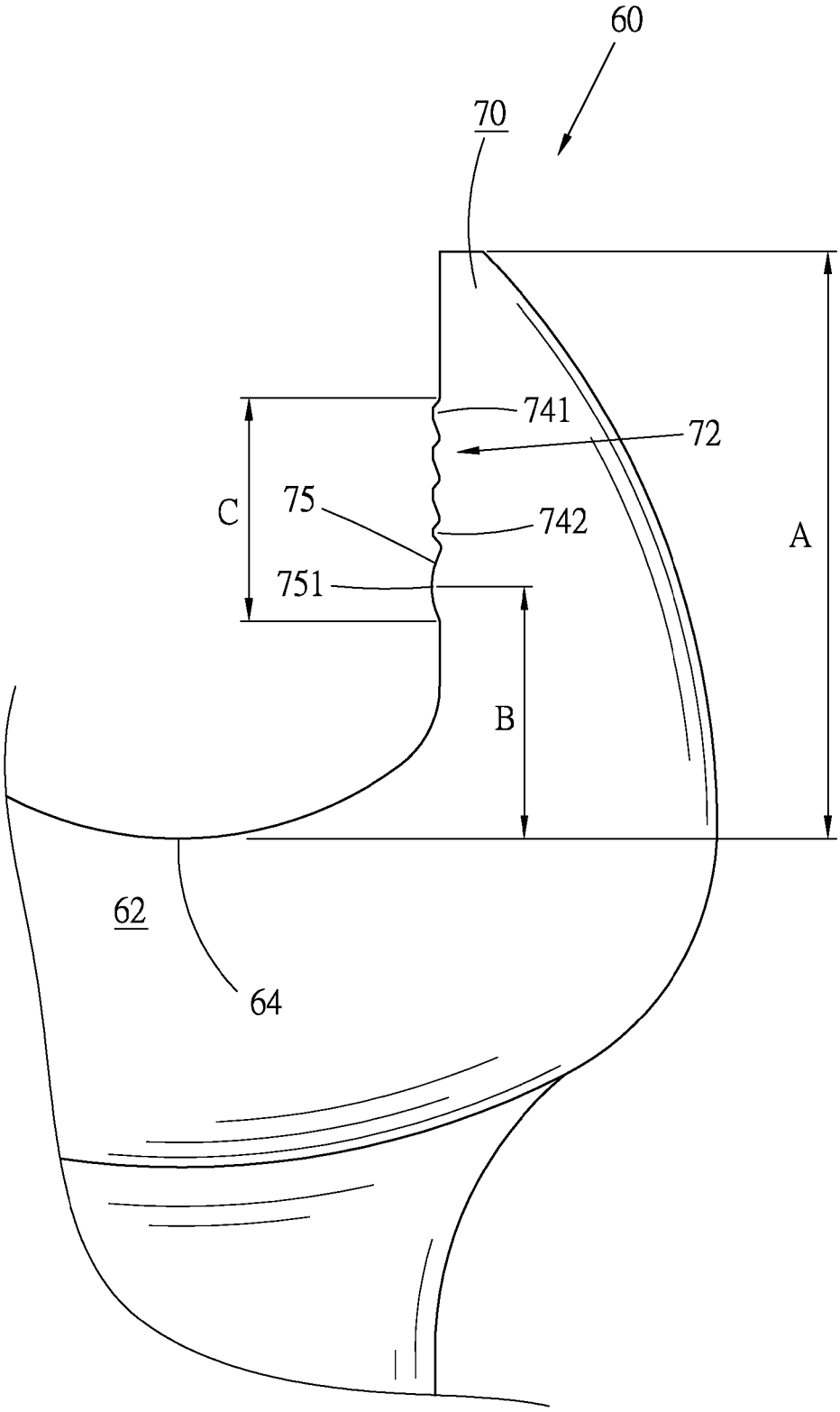
FIG. 6 is an enlarged view of a part of a third embodiment of the present invention.

FIG. 6 shows a third embodiment of the wrench 60 of the present invention, in which the second jaw is not shown. The first jaw 70 has a holding face. Similarly, multiple first sharp teeth 741, a second sharp tooth 742 and a wide tooth 75 are disposed on the holding face. The sharp teeth 741, 742 have sharp tips as in the first embodiment or have plane tooth crests as in the second embodiment. The wide tooth 75 is an arc-shaped tooth with an arced face and has a largest width among the teeth of the toothed section 72. The topmost point of the wide tooth 75 is the tooth crest 751 of the wide tooth 75. In vertical distance, the tooth crest 751 is spaced from the bottommost point 64 of the throat section 62 by a distance B; the front end of the jaw 70 is spaced from the bottommost point 64 by a distance A. The toothed section 72 has a length C. As in the first embodiment, the second length B ranges from ⅓ to ½ the first length A. The third length C is about ⅖ the first length A.

In conclusion, the wrench of the present invention has a specific structure and limitation so that the structural strength of the innermost tooth of the wrench is enhanced. Meanwhile, the wrench will not damage the corner of the threaded component. Also, when applied to the threaded component, the wrench is prevented from being stuck therewith. Therefore, the wrench can be more conveniently used. The above embodiments are only used to illustrate the present invention, not intended to limit the scope thereof. Many modifications of the above embodiments can be made without departing from the spirit of the present invention.

What is claimed is:

1. An open-end wrench for a threaded component comprising:

a handle; a first jaw and a second jaw disposed at one end of the handle; a throat section being connected between rear ends of the two jaws; each of the jaws having an inner side serving as a holding face; the throat section defining a recess between the two jaws, the holding face of the first jaw and the holding face of the second jaw are asymmetrical, the recess having a bottommost point positioned at a center of the throat section; and a toothed section being disposed on the holding face of the first jaw, the toothed section having a plurality of sharp teeth and a wide tooth continuously arranged on the holding face, the wide tooth being located between the plurality of sharp teeth and the throat section, the wide tooth having a width that is larger than a width of the plurality of sharp teeth; a raised section with a plane face being located on the holding face of the second jaw and having a top end and a bottom end, the bottom end of the raised section is located closer to the throat section than the top end thereof, the toothed section has a top end and a bottom end, the bottom end of the toothed section is located closer to the throat section than the top end thereof, the bottom end of the raised section of the second jaw and the bottom end of the toothed section are aligned and located an equal distance from the throat section;

the bottommost point of the throat section being spaced from a front end of the first jaw by a first length; the wide tooth having a tooth crest; the bottommost point of throat section being spaced from the tooth crest of the wide tooth by a second length, the second length ranging from ⅓ to ½ the first length; the toothed section having a length defined as a third length, the third length being ⅖ the first length;

wherein, when a threaded component is positioned between the first jaw and the second jaw and the threaded component is engaging the throat section, the wide tooth is spaced apart a predetermined distance from a corresponding corner of the threaded component;

wherein the wide tooth has the form of a triangle; an angle contained between two lateral sides of the wide tooth ranging from 148° to 160°.

2. The open-end wrench as claimed in claim 1, wherein the form of the triangle of the wide tooth is a form of an isosceles triangle.

3. The open-end wrench as claimed in claim 1, wherein the toothed section has four sharp teeth and the wide tooth.

4. The open-end wrench as claimed in claim 1, wherein the sharp teeth are divided into a plurality of first sharp teeth and a second sharp tooth, the second sharp tooth having a smallest width among all the teeth and the second sharp tooth being positioned between the first sharp teeth and the wide tooth.

5. The open-end wrench as claimed in claim 4, wherein the number of the first sharp teeth of the toothed section is three.

6. The open-end wrench as claimed in claim 1, wherein the sharp teeth and the wide tooth have plane tooth crests.

7. The open-end wrench as claimed in claim 1, wherein the width of the wide tooth is a distance ranging from 0.325 to 0.375 the third length.

8. An open-end wrench comprising:

a handle; a first jaw and a second jaw disposed at one end of the handle; a throat section being connected between rear ends of the two jaws; each of the jaws having an inner side serving as a holding face; the throat section defining a recess between the two jaws, the holding face of the first jaw and the holding face of the second jaw are asymmetrical, the recess having a bottommost point positioned at a center of the throat section; and a toothed section being disposed on the holding face of the first jaw, the toothed section having a plurality of sharp teeth and a wide tooth continuously arranged on the holding face, the wide tooth being located between the plurality of sharp teeth and the throat section and having a width that is larger than a width of the plurality of sharp teeth; a raised section with a plane face being located on the holding face of the second jaw and having a top end and a bottom end, the bottom end of the raised section is located closer to the throat section than the top end thereof, the toothed section has a top end and a bottom end, the bottom end of the toothed section is located closer to the throat section than the top end thereof, the bottom end of the raised section of the second jaw and the bottom end of the toothed section are aligned and located an equal distance from the throat section;

the bottommost point of the throat section being spaced from a front end of the first jaw by a first length; the wide tooth having a tooth crest; the bottommost point of throat section being spaced from the tooth crest of the wide tooth by a second length, the second length ranging from ⅓ to ½ the first length;

wherein, when a threaded component is positioned between the first jaw and the second jaw and the threaded component is engaging the throat section, the wide tooth is spaced apart a predetermined distance from a corresponding corner of the threaded component;

wherein the wide tooth has the form of a triangle; an angle contained between two lateral sides of the wide tooth ranging from 148° to 160°.

9. The open-end wrench as claimed in claim 8, wherein the toothed section has four sharp teeth and the wide tooth.

10. The open-end wrench as claimed in claim 8, wherein the plurality of sharp teeth are divided into a plurality of first sharp teeth and a second sharp tooth, the second sharp tooth having a width smaller than a width of the plurality of first sharp teeth and the wide tooth and the second sharp tooth being positioned between the first sharp teeth and the wide tooth.

11. The open-end wrench as claimed in claim 10, wherein the number of the first sharp teeth of the toothed section is three.

12. The open-end wrench as claimed in claim 8, wherein the sharp teeth and the wide tooth have plane tooth crests.

* * * * *